US010151115B1

(12) United States Patent
McAllister

(10) Patent No.: US 10,151,115 B1
(45) Date of Patent: Dec. 11, 2018

(54) SYSTEM FOR, AND METHOD OF CLEANING RAIN GUTTERS

(71) Applicant: Michael J. McAllister, Omaha, NE (US)

(72) Inventor: Michael J. McAllister, Omaha, NE (US)

( * ) Notice: Subject to any disclaimer, the term of this patent is extended or adjusted under 35 U.S.C. 154(b) by 27 days.

(21) Appl. No.: 15/530,603

(22) Filed: Feb. 4, 2017

Related U.S. Application Data

(60) Provisional application No. 62/388,710, filed on Feb. 6, 2016.

(51) Int. Cl.
*E04D 13/076* (2006.01)
*E04D 13/064* (2006.01)

(52) U.S. Cl.
CPC ..... *E04D 13/0765* (2013.01); *E04D 13/064* (2013.01)

(58) Field of Classification Search
None
See application file for complete search history.

(56) References Cited

U.S. PATENT DOCUMENTS 4,196,927 A 8/1980 Lomaga
4,238,866 A 12/1980 Taylor
4,363,335 A 12/1982 Tapper
4,640,540 A 2/1987 Chisholm
4,750,883 A 6/1988 Drake
4,848,818 A 7/1989 Smith
4,949,514 A 8/1990 Weller
5,335,460 A 8/1994 Smith, Jr.
D392,781 S 3/1998 McKnight
5,727,580 A 3/1998 Patterson
5,855,402 A 1/1999 Maraschiello
6,185,782 B1 2/2001 Hall
6,397,526 B1 6/2002 Saul et al.
6,497,317 B1 12/2002 Chun
6,766,560 B2 7/2004 Murphy
6,842,937 B2 1/2005 Li
6,945,577 B1 * 9/2005 Scott ..... E04D 13/0765 15/236.04
7,334,369 B2 2/2008 Carson
7,857,368 B2 12/2010 Duke
RE43,555 E 7/2012 Higginbotham
8,561,623 B2 10/2013 Lowenstein
8,650,699 B1 2/2014 Kovarik
9,302,297 B2 4/2016 Pullen et al.
2003/0051305 A1 * 3/2003 Hewlett ..... E04D 13/0765 15/236.04

* cited by examiner

*Primary Examiner* — Eric W Golightly
*Assistant Examiner* — Arlyn I Rivera-Cordero
(74) *Attorney, Agent, or Firm* — James D. Welch

(57) ABSTRACT

A rain gutter cleaning system having a gutter system cleaning pole (GSP) which is attached to said elongated debris contacting element (DCE) at a point off center thereof so as to form a long (LS) and short (SS) side, and method of it's use.

2 Claims, 2 Drawing Sheets

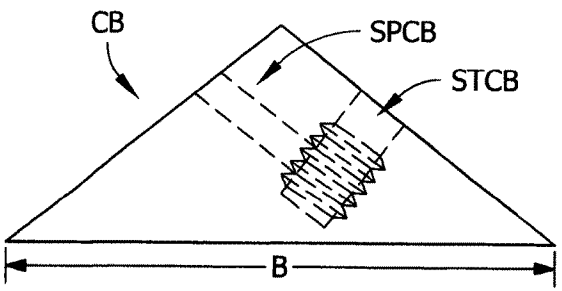
FIG. 1b
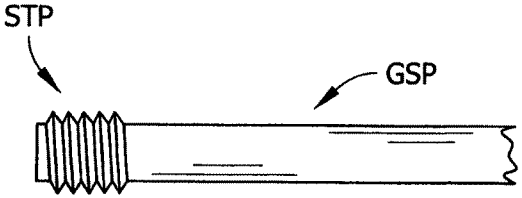
FIG. 1c
FIG. 1d
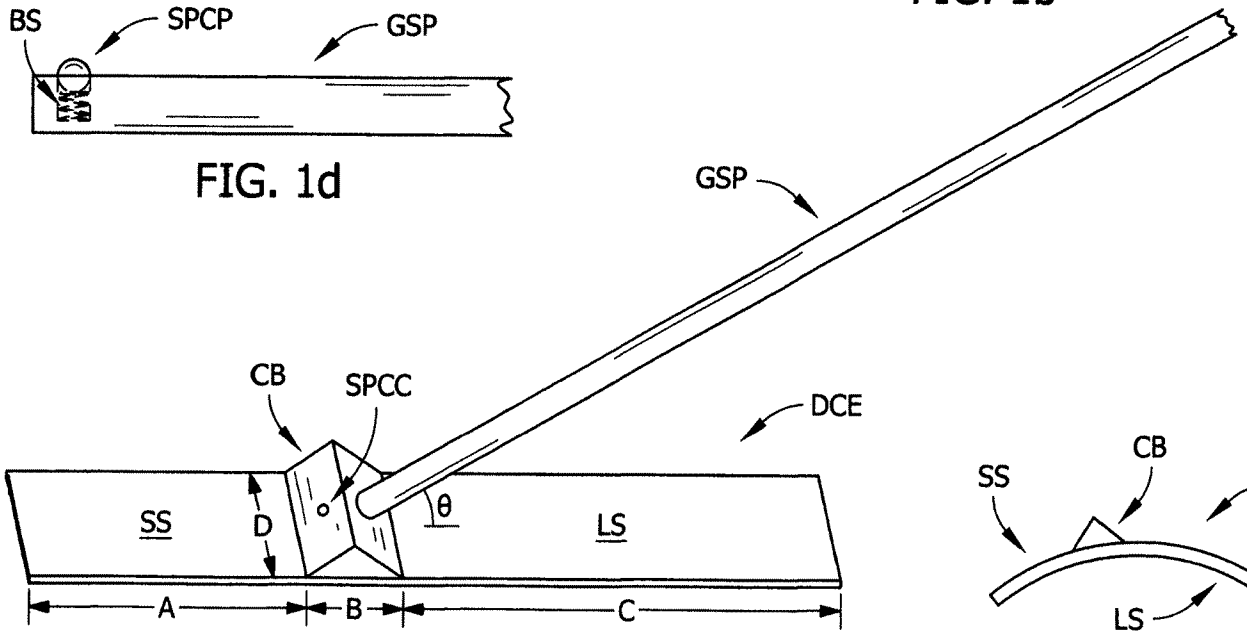
FIG. 1a
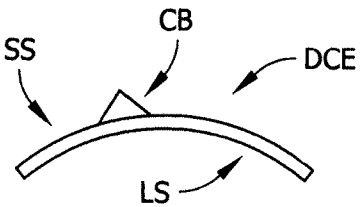
FIG. 1e

SYSTEM FOR, AND METHOD OF CLEANING RAIN GUTTERS

This Application Claims Benefit of Provisional Application Ser. No. 62/388,710, Filed Feb. 6, 2016.

TECHNICAL FIELD

The present invention relates to systems and methods for cleaning rain gutters as are commonly secured to houses by gutter studs, and more particularly to a system comprising gutter system cleaning pole (GSP) which is attached to said elongated debris contacting element (DCE) at a point off center thereof so as to form a long (LS) and short (SS) side, and method of it's use.

BACKGROUND

It is well known that rain gutters collect debris that must be cleaned therefrom. Many inventions have been Patented which serve to make the required efforts easier. The most relevant thereof, in view of the present invention, is believed to be a Patent to Cassels Jr., U.S. Pat. No. 6,526,619. Other known Patents that address rain gutter cleaning, which are not considered particularly relevant to the present invention, are disclosed for insight are: U.S. Pat. No. 4,196,927 to Lomaga, U.S. Pat. No. 4,238,866 to Taylor, U.S. Pat. No. 4,363,335 to Tapper, U.S. Pat. No. 4,640,540 to Chisholm, U.S. Pat. No. 4,750,883 to Drake, U.S. Pat. No. 4,848,818 to Smith, U.S. Pat. No. 4,949,514 to Weller, U.S. Pat. No. 5,335,460 to Smith Jr., U.S. Pat. No. 5,727,580 to Patterson, DES Pat. No. 392,781 to McKnight, U.S. Pat. No. 5,855,402 to Maraschiello, U.S. Pat. No. 6,185,782 to Hall, U.S. Pat. No. 6,497,317 to Chun, U.S. Pat. No. 6,397,526 to Saul et al., U.S. Pat. No. 6,766,560 to Murphy, U.S. Pat. No. 6,842,937 to Li, U.S. Pat. No. 6,945,577 to Scott, U.S. Pat. No. 7,334,369 to Carson, U.S. Pat. No. 7,857,368 to Duke, RE43,555 to Higginbotham, U.S. Pat. No. 8,561,6223 to Lowenstein, U.S. Pat. No. 8,650,699 to Kovarik, U.S. Pat. No. 9,267,291 to Ramsey et al., U.S. Pat. No. 9,302,297 to Pullen et al.

Even in view of known prior art, however, need remains for more convenient to use systems for and methods of rain gutter cleaning.

DISCLOSURE OF THE INVENTION

The present invention is a system for removing debris from rain gutters comprising:

a gutter system cleaning pole (GSP); and an elongated debris contacting element (DCE).

Said gutter system cleaning pole (GSP) is attached to said elongated debris contacting element (DCE) at a point off center thereof so as to form a long (LS) and short (SS) side, and so that gutter system cleaning pole (GSP) and said elongated debris contacting element (DCE) have an angle (θ) of less than 90 degrees between the long (LS) of said debris contacting element (DCE) and said gutter system cleaning pole (GSP).

A present invention method of cleaning rain gutters that contain debris, and that comprise a series of gutter studs (GS) along a length thereof for securing said Gutter to a structure, said method comprises the steps of:

a) by rotating the gutter system cleaning pole (GSP), orienting the long side (LS) of the elongated debris contacting element (DCE) so it can be placed onto said rain gutter to one side of a first gutter stud (GS1), and placing said long side (LS) into said rain gutter;

b) pulling on said gutter system cleaning pole (GSP) to cause the long side (LS) of said elongated debris contacting element (DCE) to move toward a second gutter stud (GS2) which causes debris to mover ahead thereof;

c) when said long side (LS) of said elongated debris contacting element (DCE) is stopped from further motion by said second gutter stud (GS2), removing said long side (LS) from said rain gutter and by rotating said gutter system cleaning pole (GSP) causing said short side (SS) of said elongated debris contacting element (DCE) to be oriented so that it can be placed onto said rain gutter to one side of said first second gutter stud (GS) which is beyond said second gutter stud (GS) in the direction of a third gutter stud (GS3), and placing said short side (SS) into said rain gutter so that it projects back under said second gutter stud (GS2);

d) pulling said gutter system cleaning pole (GSP) so that debris under said second gutter stud (GS2) is moved out from under said second gutter stud (G2S) and then removing said short side (SS) of said elongated debris contacting element (DCE) from said rain gutter;

e) by rotating the gutter system cleaning pole (GSP), orienting the long side (LS) of the elongated debris contacting element (DCE) so it can be placed onto said rain gutter to one side of said second gutter stud (GS2), and placing said long side (LS) into said rain gutter;

f) pulling on said gutter system cleaning pole (GSP) to cause the long side (LS) of said elongated debris contacting element (DCE) to move toward a third gutter stud (GS3) which causes debris to mover ahead thereof.

Said method can further comprise hanging said system for removing debris from rain gutters by straddling said gutter system cleaning pole (GSP), which is at an angle theta (θ) to said long side (LS), over a structure, such that said angle theta (θ) faces downward at said supporting structure, at any point during practice of steps b) through g).

The present invention will be better understood by reference to the Detailed Description in conjunction with the Drawings.

BRIEF DESCRIPTION OF THE DRAWINGS

FIG. 1*a* shows a gutter cleaning system comprised of a Gutter Cleaning System Pole (GSP) and a Debris Contacting Element (DCE) comprising a Connector Block (CB).

FIG. 1*b* shows the Connector Block (CB) in FIG. 1*a* with internal Female Connector Block Screw Threads (STCB) and/or internal Female Connector Block Serlock Pin (SPCB) receiving hole.

FIG. 1*c* shows a Gutter Cleaning System Pole (GSP) with Male Screw Threads (STP) for mating with the Female Screw Threads (STCB).

FIG. 1*d* shows a Gutter Cleaning System Pole (GSP) with a protruding Male Serlock Pin (SPCP) and internal Bias Spring (BS).

FIG. 1*e* shows that the Debris Contacting Element (DCE) can be shaped other than linearly as shown in FIG. 1*a*.

DETAILED DESCRIPTION

With reference to the FIG. 1*a*, it will be appreciated and that the present invention system comprises an elongated Gutter Cleaning System Pole (GCP) attached to an Elongated Debris Contacting Element (DCE) at one end thereof, at an angle of Theta (0) degrees to said Gutter Cleaning System Pole (GCP), which angle Theta (θ) is less that 90 Degrees. Note that the Gutter Cleaning System Pole (GCP) is mounted off center along the length of the Debris Contacting Element (DCE) so that it demonstrates a long (LS) and short (SS) side. FIG. 1*a* also shows a Connector Block (CB) which is integrated into, or otherwise attached to the Elongated Debris Contacting Element (DCE). It is noted that non-limiting workable values for "A", "B", "C", "D" and Theta (θ) in FIG. 1, are: 4", 1", 7", 2.5" and 45 Degrees respectively.

FIG. 1*b* shows the Connector Block (CB) in FIG. 1*a* with internal Female Connector Block Screw Threads (STCB) and/or internal Female Connector Block Serlock™ Pin (SPCB) receiving hole both of which can extend all the way through the length of the connecting block (CB), or end within the Connecting Block (CB). Note (SPCB) is demonstrative of a receiving hole which projects all the way though said Connector Block (CB), and (STCB) demonstrates a hole which ends within said Connector Block (CB). Either realization can be applied to either hole.

FIG. 1*c* shows said Gutter Cleaning System Pole (GSP) with Male Screw Threads (STP) for mating with the Female Screw Threads (STCB) shown in FIG. 1*b*.

FIG. 1*d* shows a Gutter Cleaning System Pole (GSP) with a protruding Male Serlock Pin (SPCP) for mating with said Female Connector Block Serlock Pin (SPCB) receiving hole in FIG. 1*b*, and internal Bias Spring (BS) for maintaining said protruding Male Serlock Pin (SPCP) in the position shown, extending from the exterior of said Gutter Cleaning System Pole (GSP).

FIG. 1*e* shows that the Debris Contacting Element (DCE) can be shaped other than linearly as shown in FIG. 1*a*. This is not meant to be limiting, but rather demonstrates that any functional shape for the Debris Contacting Element (DCE) is to be considered within the scope of the present invention.

Figure 2:
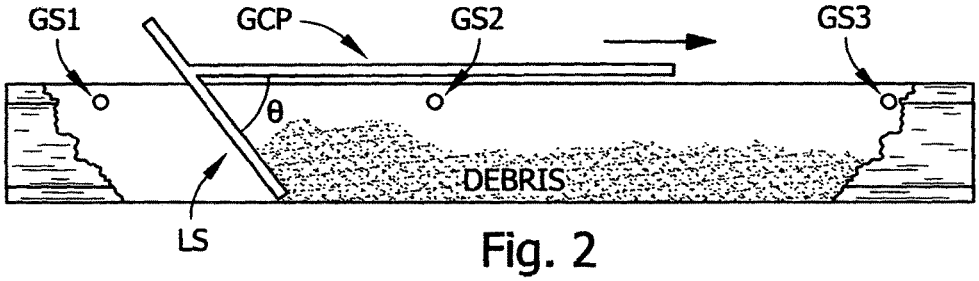
FIG. 2 shows a first step in applying said gutter cleaning system to clean debris from a gutter.
Figure 3:
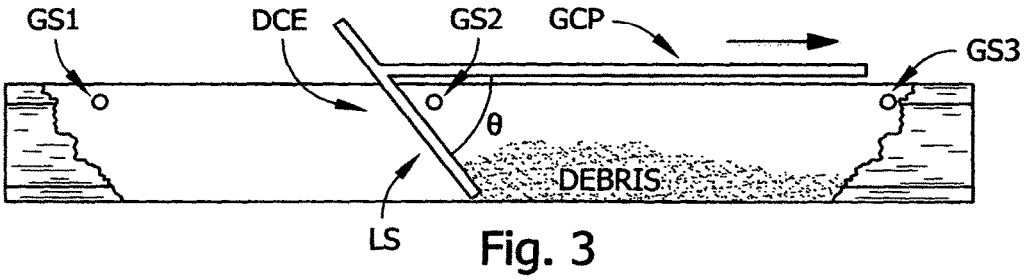
FIG. 3 shows a second step in applying said gutter cleaning system to clean debris from a gutter.
Figure 4:
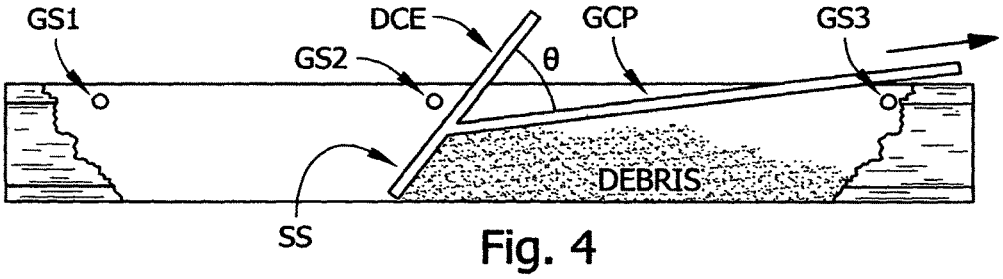
FIG. 4 shows a third step in applying said gutter cleaning system to clean debris from a gutter.
Figure 5:
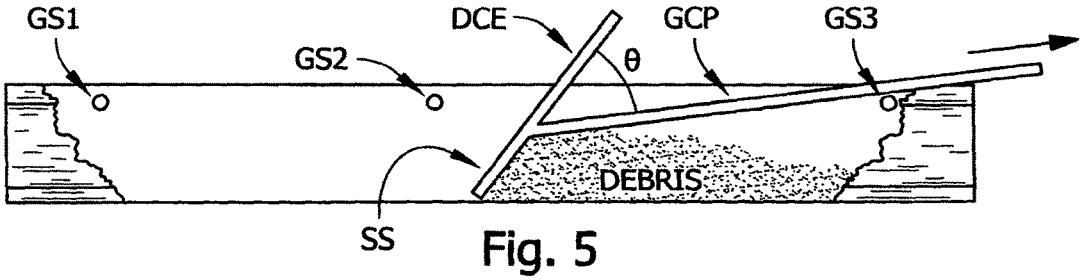
FIG. 5 shows a forth step in applying said gutter cleaning system to clean debris from a gutter.
Figure 6:
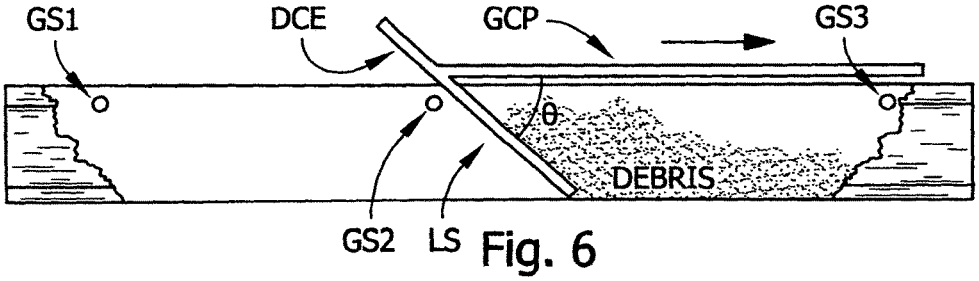
FIG. 6 shows a fifth step in applying said gutter cleaning system to clean debris from a gutter.

Importantly, the present invention also comprises a method of use of said system to make cleaning debris from rain gutters much more easy and convenient than is currently possible. With reference to FIGS. 2-6, note that said method involves pulling the Gutter Cleaning System Pole (GCP) along a debris containing rain gutter, to the right, with said angle Theta (θ) oriented to point downward, (see FIG. 2) until a Gutter Stud (GS2), which secures the Gutter to a structure, is encountered by the Long Side (LS) of the Debris Contacting Element (DCE), (see FIG. 3). This is followed by flipping the Gutter Cleaning System Pole (GCP) so that said angle Theta (θ) is pointing upward, extending the Short Side (SS) of the Debris Contacting Element (DCE) under said encountered Gutter Stud (GS2), (see FIG. 4) and then pulling the Gutter Cleaning System Pole (GCP) so that debris under said Gutter Stud (GS2) is caused to be out from under it, (see FIG. 5). This is followed by again flipping the Gutter Cleaning System Pole (GCP) so that said angle Theta (θ) is pointing downward, (see FIG. 6), and so the Long Side (LS) of the Debris Contacting Element (DCE) projects into the Gutter, and then pulling the Gutter Cleaning System Pole (GCP) further along the length of the Gutter until another Gutter Stud (GS3) is encountered by the Long Side (LS) of the Debris Contacting Element (DCE). At that point the described method is repeated as shown in FIG. 3-FIG. 6.

Having hereby disclosed the subject matter of the present invention, it should be obvious that many modifications, substitutions, and variations of the present invention are possible in view of the teachings. It is therefore to be understood that the invention may be practiced other than as specifically described, and should be limited in its breadth and scope only by the Claims.

I claim:

1. A method of cleaning rain gutters that contain debris, and that comprise a series of gutter studs (GS1) (GS2) (GS3) along a length thereof for securing said gutter to a structure, said method comprising the steps of:

a) providing a system for removing debris from rain gutters comprising:
   a gutter system cleaning pole (GSP); and
   an elongated debris contacting element (DCE);

said gutter system cleaning pole (GSP) being attached to said elongated debris contacting element (DCE) at a point off center thereof so as to form a long (LS) and short (SS) side, and so that the gutter system cleaning pole (GSP) and said elongated debris contacting element (DCE) have an angle (θ) of less than 90 degrees between the long (LS) of said debris contacting element (DCE) and said gutter system cleaning pole (GSP);

said method further comprising the steps of:

b) by rotating the gutter system cleaning pole (GSP), orienting the long side (LS) of the elongated debris contacting element (DCE) so it can be placed onto said rain gutter to one side of a first gutter stud (GS1), and placing said long side (LS) into said rain gutter;

c) pulling on said gutter system cleaning pole (GSP) to cause the long side (LS) of said elongated debris contacting element (DCE) to move toward a second gutter stud (GS2) which causes debris to move ahead thereof;

d) when said long side (LS) of said elongated debris contacting element (DCE) is stopped from further motion by said second gutter stud (GS2), removing said long side (LS) from said rain gutter and by rotating said gutter system cleaning pole (GSP) causing said short side (SS) of said elongated debris contacting element (DCE) to be oriented so that it can be placed onto said rain gutter to one side of said second gutter stud (GS2) which is beyond said second gutter stud (GS2) in the direction of a third gutter stud (GS3), and placing said short side (SS) into said rain gutter so that it projects back under said second gutter stud (GS2);

e) pulling said gutter system cleaning pole (GSP) so that debris under said second gutter stud (GS2) is moved out from under said second gutter stud (GS2) and then removing said short side (SS) of said elongated debris contacting element (DCE) from said rain gutter;

f) by rotating the gutter system cleaning pole (GSP), orienting the long side (LS) of the elongated debris contacting element (DCE) so it can be placed onto said rain gutter to one side of said second gutter stud (GS2), and placing said long side (LS) into said rain gutter;

g) pulling on said gutter system cleaning pole (GSP) to cause the long side (LS) of said elongated debris contacting element (DCE) to move toward said third gutter stud (GS3) which causes debris to move ahead thereof.

2. The method as in claim 1, which further comprises hanging said system for removing debris from the rain gutter by straddling said gutter system cleaning pole (GSP) over a structure, such that the angle (θ) formed between the long side (LS) of said debris contacting element (DCE) and said gutter system cleaning pole (GSP) faces downward at said supporting structure at any point during practice of the steps b) through g).

* * * * *